US010670991B2

(12) United States Patent
Mishima et al.

(10) Patent No.: US 10,670,991 B2
(45) Date of Patent: Jun. 2, 2020

(54) DEVELOPING DEVICE

(71) Applicant: CANON KABUSHIKI KAISHA, Tokyo (JP)

(72) Inventors: Kouhei Mishima, Kashiwa (JP); Dai Kanai, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/253,576

(22) Filed: Jan. 22, 2019

(65) Prior Publication Data

US 2019/0227461 A1 Jul. 25, 2019

(30) Foreign Application Priority Data

Jan. 23, 2018 (JP) ..... 2018-009112

(51) Int. Cl.
*G03G 15/08* (2006.01)

(52) U.S. Cl.
CPC ..... *G03G 15/0889* (2013.01); *G03G 15/0891* (2013.01); *G03G 2215/085* (2013.01)

(58) Field of Classification Search
CPC ..... G03G 15/0889; G03G 15/0891; G03G 2215/085
See application file for complete search history.

(56) References Cited

U.S. PATENT DOCUMENTS

| | | | | |
|---|---|---|---|---|
| 6,834,175 | B2 | 12/2004 | Murayama et al. | |
| 8,571,446 | B2 * | 10/2013 | Iwata | G03G 15/0893 399/254 |
| 8,620,191 | B2 | 12/2013 | Okazaki et al. | |
| 9,696,659 | B2 * | 7/2017 | Tanaka | G03G 15/0893 |
| 2013/0078002 | A1 * | 3/2013 | Stelter | G03G 15/0893 399/254 |

FOREIGN PATENT DOCUMENTS

| | | | |
|---|---|---|---|
| JP | H08-286480 | A | 11/1996 |
| JP | 2003-270947 | A | 9/2003 |
| JP | 2006-337817 | A | 12/2006 |
| JP | 2010-256429 | A | 11/2010 |
| JP | 2012-003193 | A | 1/2012 |

OTHER PUBLICATIONS

Kouhei Mishima et al., U.S. Appl. No. 16/253,566, filed Jan. 22, 2019.

* cited by examiner

*Primary Examiner* — Gregory H Curran
(74) *Attorney, Agent, or Firm* — Venable LLP

(57) ABSTRACT

A developing device includes a developer container configured to accommodate a developer containing toner and a carrier and a feeding screw provided rotatably in the developer container and configured to feed the developer in a predetermined feeding direction. The feeding screw includes a rotation shaft, and a first helical blade and a second helical blade which are formed around the rotation shaft and which form a multi-thread helical blade. The feeding screw includes a region in which a plate-like projection portion is provided on the rotation shaft between the first helical blade and the second helical blade.

13 Claims, 7 Drawing Sheets

DEVELOPING DEVICE

The present invention relates to a developing device suitable for an image forming apparatus, such as a printer, a copying machine, a facsimile machine or a multi-function machine, using electrophotography.

The image forming apparatus, such as the printer, the copying machine, the facsimile machine or the multi-function machine includes the developing device for developing and visualizing, with a developer, an electrostatic latent image formed on a photosensitive drum. In the developing device, a two-component developer consisting of toner and a carrier is used. In order to uniformize a toner content in the developer and to electrically charge the toner to a proper charge amount, the developer is stirred and fed by a feeding screw (Japanese Laid-Open Patent Application (JP-A) 2010-256429, JP-A 2006-337817 and JP-A 2012-3193). In order to improve a feeding property of the developer by the feeding screw, i.e., in order to efficiently stir the developer, a helical blade of a feeding screw is partially omitted (removed) in a developing device disclosed in JP-A 2010-256429, and a feeding screw is provided with a rib in a developing device disclosed in JP-A 2006-337817 and JP-A 2012-3193.

Incidentally, recently, there is a tendency that an amount of the developer accommodated in the developing device in advance is decreased for downsizing and cost reduction of the image forming apparatus. Further, when an increase in amount per unit time of the toner subjected to development with speed-up of printing, the adjacent per unit time of supplied toner increases. Even in such a case, as described above, in order to uniformize the toner content and to electrically charge the toner to the proper charge adjacent as soon as possible, the feeding screw can be provided with the rib and the helical blade of the feeding screw can be partially omitted. However, when the feeding screw is provided with the rib or the helical blade of the feeding screw is partially omitted, a stirring property of the developer is enhanced, but on the other hand, the feeding property of the developer lowers, and therefore, there was a liability that feeding of the developer does not keep up with the development, and thus the developer, i.e., the toner in a sufficient amount, is not subjected to the development.

SUMMARY OF THE INVENTION

A principal object of the present invention is to provide a developing device capable of compatibly realizing a feeding property of a developer and a stirring property of the developer.

According to an aspect of the present invention, there is provided a developing device comprising: a developer container configured to accommodate a developer containing toner and a carrier; and a feeding screw provided rotatably in the developer container and configured to feed the developer in a predetermined feeding direction, the feeding screw including a rotation shaft, and a first helical blade and a second helical blade which are formed around the rotation shaft and which form a multi-thread helical blade, wherein the feeding screw includes a region in which a plate-like projection portion is provided on the rotation shaft between the first helical blade and the second helical blade.

Further features of the present invention will become apparent from the following description of exemplary embodiments with reference to the attached drawings.

DESCRIPTION OF EMBODIMENTS

[Image Forming Apparatus]

Figure 1:
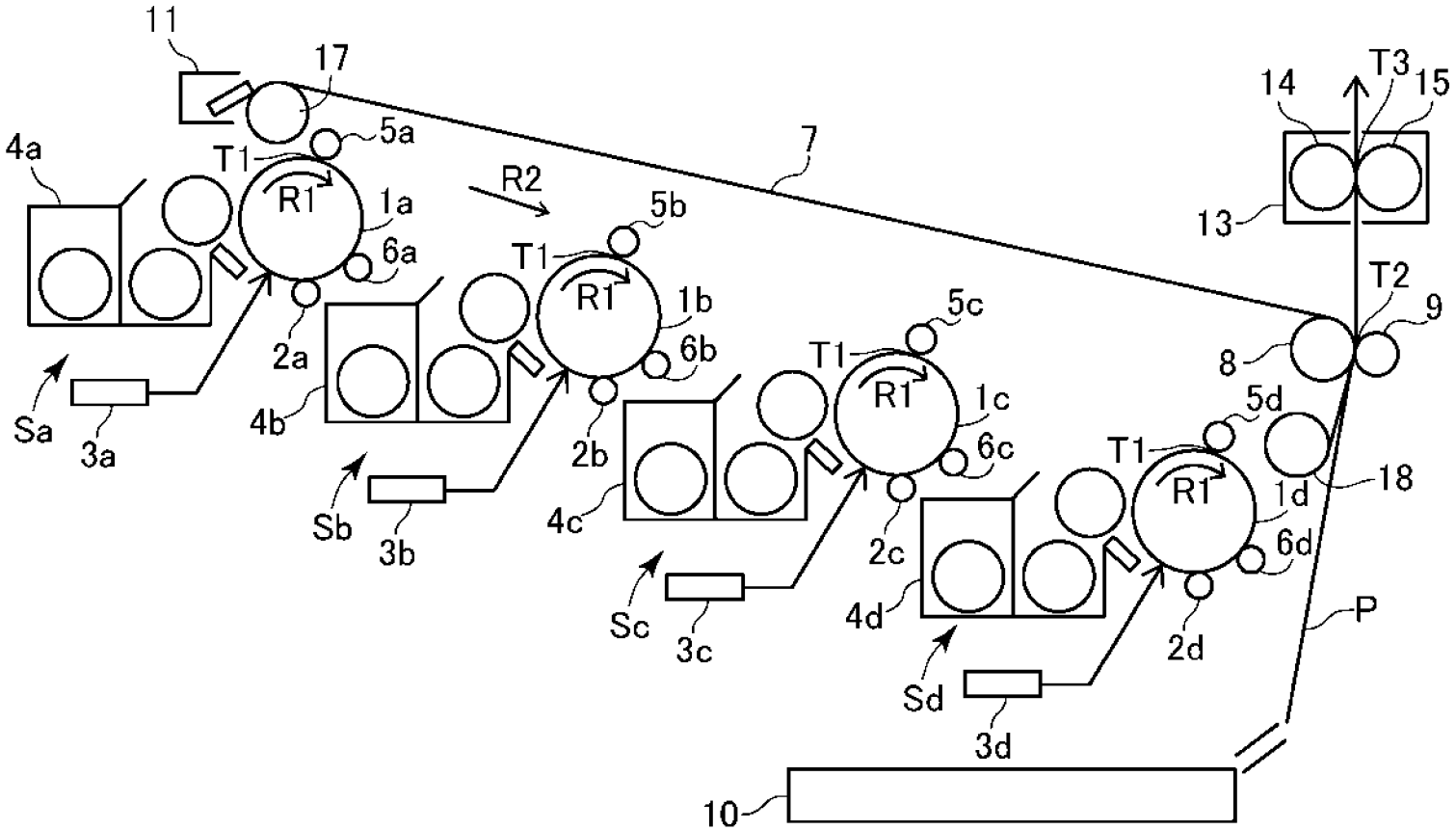
FIG. 1 is a schematic view showing a structure of an image forming apparatus to which a developing device of an embodiment is applied.

First, a schematic structure of an image forming apparatus to which a developing device according to an embodiment is applied will be described with reference to FIG. 1. An image forming apparatus shown in FIG. 1 is an intermediary transfer type full-color printer of a tandem type in which image forming portions Sa, Sb, Sc and Sd are arranged along an intermediary transfer belt 7.

At the image forming portion Sa, a yellow toner image is formed on a photosensitive drum 1*a* and then is transferred onto the intermediary transfer belt 7. At the image forming portion Sb, a magenta toner image is formed on a photosensitive drum 1*b* and then is transferred onto the intermediary transfer belt 7. At the image forming portion Sc and Sd, cyan and black toner images are formed on photosensitive drums 1*c* and 1*d* respectively, and then are transferred onto the intermediary transfer belt 7. The four color toner images transferred on the intermediary transfer belt 7 are fed to a secondary transfer portion T2 and are secondary-transferred together onto a recording material P (sheet material such as a sheet or an OHP sheet).

The image forming portions Sa, Sb, Sc and Sd have the substantially same constitution except that colors of toners used in developing devices 4*a*, 4*b*, 4*c* and 4*d*, respectively, are yellow, magenta, cyan and black, respectively. In the following, constituent elements of the image forming portions are represented by reference numerals or symbols from which suffixes a, b, c and d for representing a difference in color for the image forming portions Sa, Sb, Sc and Sd are omitted, and constitutions and operations of the image forming portions Sa to Sd will be described.

The image forming portion S includes, at a periphery of the photosensitive drum 1 as an image bearing member, a primary charger 2, an exposure device 3, the developing device 4, a primary transfer roller 5 and a secondary charger 6. The photosensitive drum 1 is prepared by forming a photosensitive layer which is a negatively chargeable organic optical semiconductor on an outer peripheral surface of an aluminum cylinder, and is rotated in an arrow R1 direction in FIG. 1 at a predetermined process speed (for example, 250 mm/s) by an unshown motor. The photosensitive drum 1 is formed in a diameter of, for example, 30 mm and a length of, for example, 360 mm with respect to a rotational axis direction (longitudinal direction).

The primary charger 2 is a charging roller formed in, for example, a roller shape and electrically charges the photosensitive drum 1 to a uniform negative dark-portion potential in contact with the photosensitive drum 1 under application of a charging voltage by an unshown high-voltage source. The charging roller as the primary charger is urged toward the photosensitive drum 1 by an unshown pressing (urging) spring, and therefore, is rotated by the photosensitive drum 1. As regards a charging voltage applied to the charging roller, for example, a superposed voltage in the form of a DC voltage of −900 V biased with an AC voltage of 1500 V in terms of a peak-to-peak voltage is applied to the charging roller. The charging roller is, for example, 14 mm in diameter and 320 mm in length with respect to a rotational axis direction (longitudinal direction).

The exposure device 3 generates a laser beam, from a laser beam emitting element (not shown), obtained by subjecting scanning line image data which is developed from an associated color component image to ON-OFF modulation and then to scanning through a rotating mirror (not shown), so that an electrostatic image for an image is formed on the surface of the charged photosensitive drum 10. The secondary charger 6 disposed upstream of the primary charger 2 with respect to the rotational direction of the photosensitive drum 1 is an auxiliary charger for assisting the charging of the photosensitive drum 1 by the primary charger 2.

Figure 2:
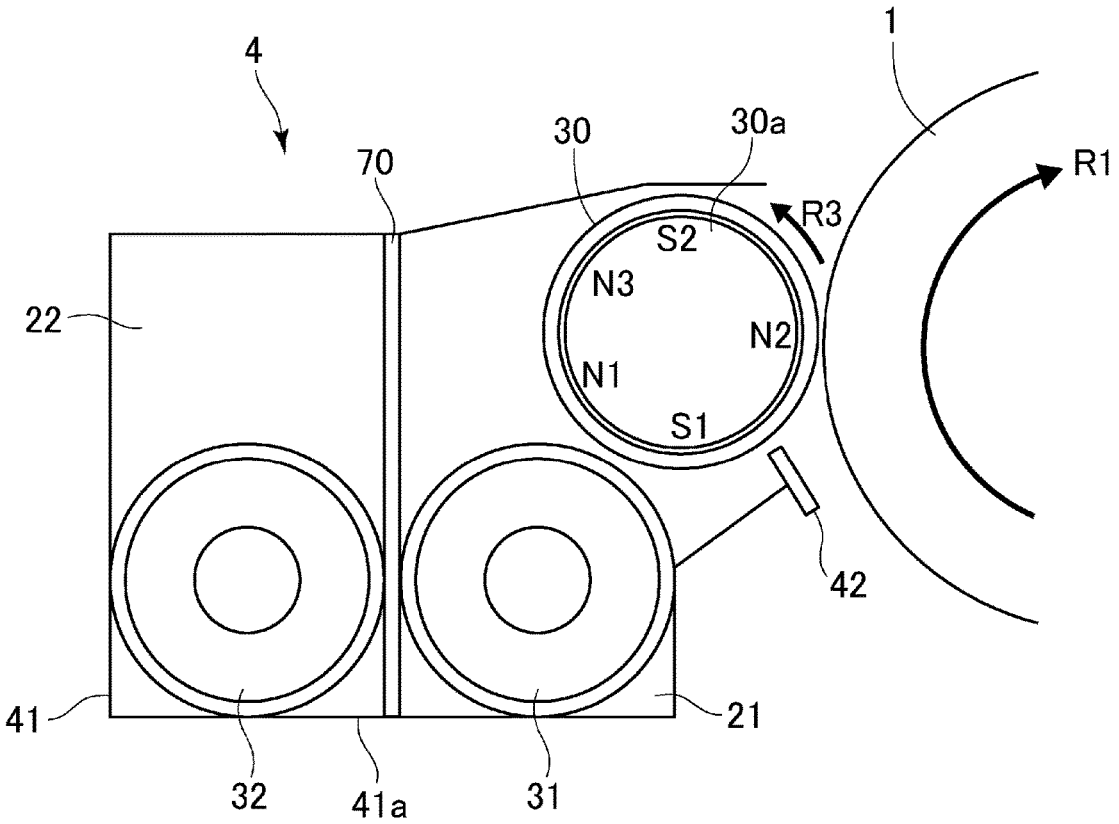
FIG. 2 is a sectional view showing the developing device of the embodiment.
Figure 3:
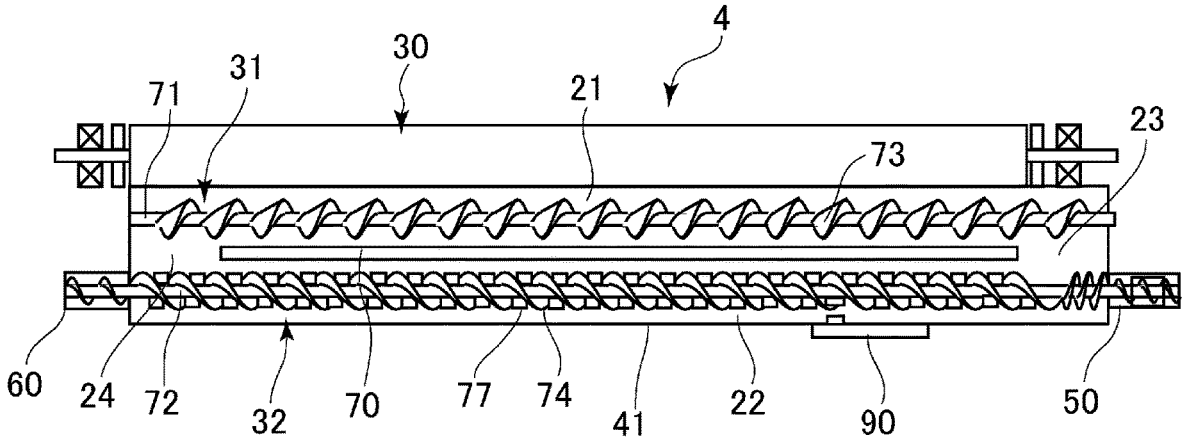
FIG. 3 is a top view showing the developing device as seen in a horizontal cross section containing an axial direction.

The developing device 4 supplies the toner to the photosensitive drum 1 and develops the electrostatic image into the toner image. The developing device 4 will be specifically described later (FIGS. 2 and 3).

The primary transfer roller 5 is disposed opposed to the photosensitive drum 1 via the intermediary transfer belt 7 and forms a toner image primary transfer portion T1 between the photosensitive drum 1 and the intermediary transfer belt 7. By applying a primary transfer voltage from a high-voltage source (not shown) to the primary transfer roller 5 at the primary transfer portion T1, the toner image is primary-transferred from the photosensitive drum 1 onto the intermediary transfer belt 7. That is, when the primary transfer voltage of an opposite polarity to a change polarity of the toner is applied to the primary transfer roller 5, the toner image on the photosensitive drum 1 is electrically attracted to the intermediary transfer belt 7, so that transfer of the toner image is carried out.

The intermediary transfer belt 7 is extended around and supported by an inner secondary transfer roller 8 and tension rollers 17 and 18 and the like, and is driven by the inner secondary transfer roller 8 also functioning as the driving roller, so that the intermediary transfer belt 7 is rotated in an arrow R2 direction in FIG. 1. The intermediary transfer belt 7 is rotated at the substantially same speed as a rotational speed (process speed) of the photosensitive drum 1. The secondary transfer portion T2 is a toner image transfer nip where the toner image is transferred onto a recording material P formed by contact of the inner secondary transfer roller 8 with the intermediary transfer belt 7 supported by an outer secondary transfer roller 9. At the secondary transfer portion T2, by applying a secondary transfer voltage to the inner secondary transfer roller 8, the toner image is secondary-transferred from the intermediary transfer belt 7 onto the recording material P fed to the secondary transfer portion T2. The recording material P is accommodated in a sheet (paper) feeding cassette 10 in a stacked state, and is fed from the sheet feeding cassette 10 to the secondary transfer portion T2 by an unshown sheet feeding roller, feeding roller and registration roller and the like. Secondary transfer residual toner remaining on the intermediary transfer belt 7 while being deposited on the intermediary transfer belt 7 is removed by a belt cleaning device 11 by rubbing the intermediary transfer belt 7. The belt cleaning device 11 removes the secondary transfer residual toner by rubbing the intermediary transfer belt 7 with a cleaning blade.

The recording material P on which the four color images are secondary-transferred at the secondary transfer portion T2 is fed to a fixing device 13. The fixing device 13 forms a fixing nip T3 by contact of fixing rollers 14 and 15 and fixes the toner images on the recording material S while feeding the recording material P through the fixing nip T3. In the fixing device 13, the fixing roller 15 is press-contacted by an urging mechanism (not shown) to the fixing roller 14 internally heated by a lamp heater (not shown), so that the fixing nip T3 is formed. The recording material P is nipped and fed through the fixing nip and thus heated and pressed, so that the toner images are formed on the recording material P. The recording material P on which the toner images are fixed by the fixing device 13 is discharged to an outside of the image forming apparatus.

[Developing Device]

The developing device 4 in this embodiment will be described using FIGS. 2 and 3. The developing device 4 includes, as shown in FIG. 2, a developer container 41, a regulating blade 42, a developing sleeve 30, a developing screw 31, a stirring screw 32, and the like.

In the developer container 41, a two-component developer containing a non-magnetic toner and a magnetic carrier is accommodated. In this embodiment, a two-component developing system is used as a developing system and the developer in which a negatively chargeable non-magnetic toner and a positively chargeable magnetic carrier are mixed is used. The non-magnetic toner is obtained by incorporating a colorant, an external additive such as colloidal silica fine powder and a wax or the like into a resin material such as polyester resin or styrene-acrylic resin, and is formed in a powdery form by pulverization or polymerization. The magnetic carrier is obtained by coating a resin material on a surface layer of a core formed of, for example, ferrite particles or resin particles kneaded with magnetic powder.

The developer container 41 is open at a part thereof opposing the photosensitive drum 1, and the developing sleeve 30 is provided rotatably in the developer container 41 so as to be partly exposed through an opening of the developer container 41. The developing sleeve 30 is formed in a cylindrical shape using a non-magnetic material such as an aluminum alloy and is rotationally driven in an arrow R3 direction in FIG. 2 at a predetermined process speed (for example, 250 mm/s). The developing sleeve 30 is formed in 20 mm in diameter and 334 mm in length with respect to a rotational axis direction (longitudinal direction). Inside the developing sleeve 30, a magnet roller 30*a* constituted by a plurality of magnetic poles is provided non-rotatably.

The developing sleeve 30 rotates in the arrow R3 direction as shown in FIG. 2, and carries and feeds, in a direction of the regulating blade 42, the developer attracted to the magnet roller 30*a* at a position of a scooping magnetic pole N1 of the magnet roller 30*a*. The developer erected by a regulating magnetic pole S1 receives a shearing force by the regulating blade 42 when passed through a gap between the developing sleeve 30 and the regulating blade 42, so that an amount thereof is regulated and thus a developer layer having a predetermined layer thickness is formed on the developing sleeve 30. The formed developer layer is carried and fed to a developing region opposing the photosensitive drum 1 and develops the electrostatic latent image, formed on the surface of the photosensitive drum 1, in a state in which a magnetic chain of the developer is formed by a developing magnetic pole N2. The developer subjected to the development is peeled off the developing sleeve 30 by a non-magnetic band formed by adjacency of the same poles between a peeling magnetic pole N3 and the scooping magnetic pole N1.

In the developer container 41, a developing chamber 21 and a stirring chamber 22 are formed, and between the developing chamber 21 and the stirring chamber 22, a partition wall 70 for partitioning an inside of the developer container 41 into the developing chamber 21 and the stirring chamber 22 is provided. The partition wall 70 partitions the inside of the developer container 41 into the developing chamber 21 and the stirring chamber 22 by projecting from a bottom portion 41*a* of the developer container 41. The partition wall 70 extends in a rotational axis direction (longitudinal direction) of the developing sleeve 30, and partitions an inside of the developer container 41 so that the developing chamber 21 and the stirring chamber 22 are arranged in the substantially horizontal direction.

The partition wall 70 includes as shown in FIG. 3, a first communication portion 23 and a second communication portion 24 each for establishing communication between the developing chamber 21 and the stirring chamber 22 on both longitudinal end sides. The first communication portion 23 is a developer delivering path for permitting delivery of the developer from the stirring chamber 22 to the developing chamber 21, and the second communication portion 24 is a developer delivering path for permitting delivery of the developer from the developing chamber 21 to the stirring screw 32.

In the developer container 21, a developing screw 31 capable of feeding the developer in a predetermined first direction in the developer container 21 is provided. In the stirring chamber 22, a stirring screw 32 capable of feeding the developer in a second direction opposite to the first direction is provided. The developing screw 31 and the stirring screw 32 are constituted by helically forming blades 73 and 74 around rotation shafts 71 and 72, respectively, as specifically described later, and are supported rotatably by the developer container 41.

Each of the developing sleeve 30, the developing screw 31 and the stirring screw 32 is constituted so as to be connection-driven by an unshown gear train, and is rotated by a driving force from an unshown driving motor via the gear train.

By rotation of the developing screw 31 and the stirring screw 32, the developer is circulated and fed in the developer container 41. At this time, with respect to a developer feeding direction (second direction) of the stirring screw 32, the developer is delivered from the stirring chamber 22 to the developing chamber 21 through the first communication portion 23 on a downstream side and is delivered from the developing chamber 21 to the stirring chamber 22 through the second communication portion 24 on an upstream side. As a result, a circulating path of the developer is formed in the developer container by the developing chamber 21 and the stirring screw 22, so that the developer is circulated in the circulating path while being stirred and fed. Incidentally, in the following description, in the case where the feeding direction is mentioned unless otherwise specified, the feeding direction refers to the developer feeding direction (second direction) of the stirring screw 32.

<Supply and Discharge of Developer>

In the case where the developing device 4 to this embodiment in which development is carried out with the two-component developer, the toner is consumed by the development, so that a toner content of the developer accommodated in the developer container 41 can be lower than a proper range (for example, 6-9%). In the case where the developer having the toner content which lowers and is out of the proper range, an image defect is liable to generate. Therefore, in order to restore the toner content to the proper range, control for restoring the toner content to the proper range, for example, a supply developer (supply agent), in which the toner and the carrier are mixed in a weight ratio of 9:1, is supplied from a supplying device (not shown) connected with the developing device is carried out. The supply agent is appropriately supplied in a supply amount depending on a consumption amount of the toner.

As shown in FIG. 3, the developer container 41 is provided with a supplying member portion 60 for receiving the supply agent from the supplying device (not shown) formed on a side upstream of the second communication portion 24 of the stirring member 22.

However, when the amount of the developer becomes excessively large in the developer container 41 with supply of the supply agent, stirring of the developer becomes insufficient, so that the image defect is liable to generate. In order to avoid this problem, a developer discharging portion 50 provided with a discharge opening for permitting discharge of an excessive developer due to supply of the supply agent so that the excessive developer is discharged from the developer container 41 is formed on a side downstream of the first communication portion 23 of the stirring chamber 22, with respect to the feeding direction, for example. Further, an inductance sensor 90 which is a content detecting sensor for detecting a weight ratio of the toner and the carrier of the developer is provided in the stirring chamber 22. This inductance sensor 90 is disposed at least on a side downstream of a longitudinal center of the stirring screw 32 with respect to the feeding direction of the stirring screw 32.

Incidentally, the supplying agent (principally the toner) supplied from the unshown supplying device to the stirring chamber 22 as described above is stirred and fed by the stirring screw 32 in order to uniformize the toner content by being mixed with the developer remaining in the stirring chamber 22 or to charge the toner. In order to sufficiently stir the supply agent with the remaining developer, as specifically described later, the stirring screw 32 in this embodiment is provided with a stirring rib 77 as a rib member. The stirring rib 77 may preferably be provided at least on an upstream side of the longitudinal center of the stirring screw 32 with respect to the feeding direction of the stirring screw 32. Further, in this embodiment, the stirring rib 77 is disposed on a side downstream of the supplying portion 60 with respect to the feeding direction of the stirring screw 32. In this embodiment, with respect to the feeding direction of the stirring screw 32 in the stirring chamber 22, in a region at least upstream of the longitudinal center of the stirring screw 32, the stirring rib 77 is provided in a region between blades of an entirety of the stirring screw 32. In the region at least upstream of the longitudinal center of the stirring screw 32, when a constitution in which the stirring rib 77 is provided in a region of blades of at least half of the entirety of the stirring screw 32 is employed, it is possible to improve a stirring property. Incidentally, as shown in FIG. 3, in this embodiment, the stirring rib 77 is provided over an entire longitudinal region of the stirring screw 32.

As already described above, recently, with downsizing of the image forming apparatus, there is a tendency that an amount of the developer accommodated in advance in the developer container 41 is decreased. Further, with speed-up of printing, an amount per unit time of the toner supplied increases. Even in such a case, there is a need to further enhance the stirring property of the developer for uniformizing the toner content as soon as possible or for charging the toner to a proper charge amount or for the like purpose. Therefore, it would be considered that the stirring screw is provided with a rib, but when the rib is provided, the developer feeding property inevitably lowers. For that reason, feeding of the developer from the stirring chamber 22 to the developing chamber 21 does not catch up with the development, so that there is a liability that the toner in a sufficient amount is not subjected to the development of the electrostatic latent image.

In view of the above, in this embodiment, a constitution in which in order to improve the developer feeding property without lowering the developer feeding property to the extent possible, as the feeding screw, the stirring screw 32 is formed by a multi-thread screw and the multi-thread stirring screw 32 is provided with the stirring rib 77 is provided is employed. Incidentally, for easy understanding of description, in this embodiment, although the stirring screw 32 will be described as an example, this embodiment is also applicable to the developing screw 31, and the developing screw 31 was omitted from illustration and description.

As regards the stirring screw in this embodiment, the case where the stirring screw is a two-thread screw and the case where the stirring screw is a three-thread screw will be described as an example. In each of the embodiments described below, the same constituent elements will be briefly described or omitted from description by adding the same reference numerals or symbols. Incidentally, the stirring screw in this embodiment is not limited to that having the number of threads which is two or three. Further, as regards the stirring screw, a stirring screw having helical blades formed with the same outer diameter will be described as an example, but is not limited thereto. The stirring screw may also be formed so that the outer diameters of the respective helical blades are different from each other or so that the outer diameters of the respective helical blades are different from each other with respect to the feeding direction.

First Embodiment

Figure 4:
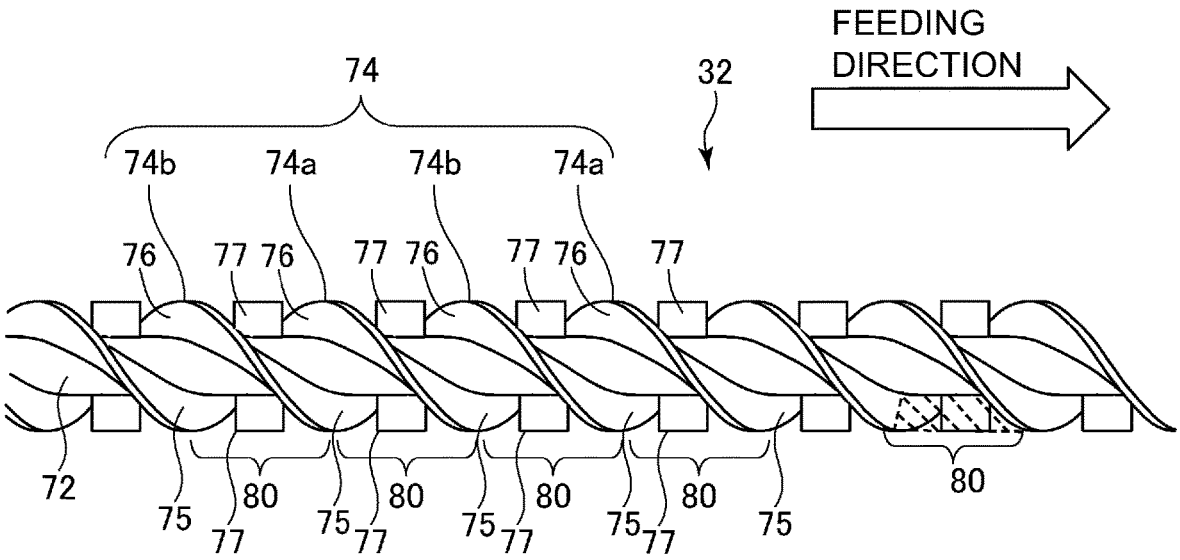
FIG. 4 is a schematic view showing a part of a stirring screw which is a two-thread screw in a First Embodiment.
Figure 5:
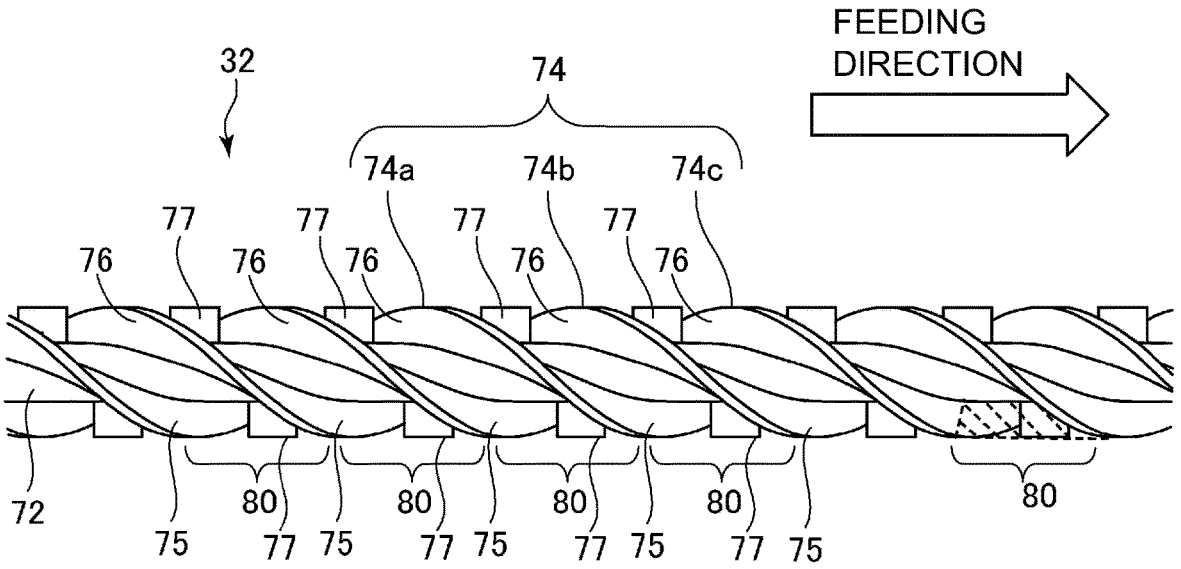
FIG. 5 is a schematic view showing a part of a stirring screw which is a three-thread screw in the First Embodiment.

A stirring screw in a First Embodiment will be described using FIGS. 4 and 5. FIG. 4 shows the case where the stirring screw is the two-thread screw and FIG. 5 shows the case where the stirring screw is the three-thread screw. The stirring screw 32 shown in FIG. 4 is a two-thread screw such that two helical blades consisting of a first helical blade 74*a* and a second helical blade 74*b* are formed as a multi-thread helical blade 74 around a rotation shaft 72. For example, the stirring screw 32 is formed in an outer diameter of 14 mm, and each of the first helical blade 74*a* and the second helical blade 74*b* is formed in the same pitch of 30 mm. Further, the rotation shaft 72 has a diameter of 6 mm, for example.

As shown in FIG. 4, the stirring screw 32 is provided with a stirring rib 77 projecting from the rotation shaft 72 in a radial direction in a first region 80 between the helical blades as indicated by a hatched line in the figure between the first helical blade 74*a* and the second helical blade 74*b* with respect to the feeding direction. In other words, the stirring screw 32 includes the first region 80 in which the stirring rib 77 is provided. The first region 80 is a region under the rotation shaft 72 between the helical blades. The stirring rib 77 is formed in a substantially same height of, for example, 4 mm with respect to the radial direction (i.e., a radial direction height from a surface of the rotation shaft 72 or a projection amount). That is, the stirring rib 77 may preferably be formed so that an outer peripheral end thereof does not largely project in the radial direction more than an outer peripheral end of the helical blade 74 of the stirring screw 32. That is, even when the outer peripheral end of the stirring rib 77 projects in the radial direction more than the outer peripheral end of the helical blade 74, a constitution in which a maximum projection amount is 1 mm or less may desirably be employed. This is because when the outer peripheral end of the stirring rib 77 projects outwardly more than the outer peripheral end of the helical blade 74, the developer feeding property can be prevented. In this embodiment, the outer peripheral end of the stirring rib 77 is positioned inside the outer peripheral end of the helical blade 74. Incidentally, the stirring rib 77 projects from the rotation shaft 72, but a constitution in which the stirring rib 77 has substantially no stirring function such that the projection amount is very small does not correspond to a constitution of the present invention. In this embodiment, the radial direction height (projection amount from the rotation shaft 72) of the stirring rib 77 is 1 mm or more.

In the case of this embodiment, the stirring rib 77 is provided so as not to contact adjacent helical blades 74 with respect to the feeding direction. Specifically, the stirring rib 77 does not contact feeding surfaces (front surfaces) 75 of the adjacent helical blades (74*a*, 74*b*) on an upstream side with respect to the feeding direction and feeding back surfaces 76 of the adjacent helical blades (74*b*, 74*a*) on a downstream side with respect to the feeding direction. The stirring rib 77 is formed in the substantially same length of, for example, 5 mm with respect to the feeding direction and is disposed between the adjacent first helical blade 74*a* and the adjacent second helical blade 74*b*. The stirring rib 77 is disposed continuously in each of first regions 80 between the helical blades with respect to the feeding direction while maintaining a phase deviation of 180° with respect to a circumferential direction of the rotation shaft 72. Thus, a plurality of first regions 80 each provided with the stirring rib 77 are continuously provided as a part of the stirring screw 32. Incidentally, the length of the stirring rib 77 with respect to the feeding direction may preferably be less than "P/N×0.5" in the case where the number of threads of the helical blade is N and a pitch of the helical blade is P. Further, the phase deviation when the stirring rib 77 is disposed along the circumferential direction is not limited to 180°.

On the other hand, a stirring screw 32 shown in FIG. 5 is a three-thread screw including, as a helical blade 74, three helical blades consisting of a first helical blade 74*a*, a second helical blade 74*b* and a third helical blade 74*c*. For example, the respective helical blades (74*a* to 74*c*) are formed in the same pitch of 50 mm. Also in this case, similarly as in the case of the above-described two-thread screw, the stirring screw 32 is provided with stirring ribs 77 each projecting from the rotation shaft 72 in the radial direction so as not to contact the adjacent helical blades 74 in the first region 80 between the helical blades as indicated by a hatched line in the figure.

As described above, in this embodiment, compared with the case where the stirring screw 32 is a single (one)-thread screw, the stirring screw 32 is constituted as the multi-thread screw including multi-thread helical blades having a larger area of the developer feeding surface 75, so that the developer feeding property can be improved. On the other hand, the stirring screw 32 is provided with the stirring ribs 77 each between the adjacent helical blades, so that the developer stirring property can be improved. Each of the stirring ribs 77 is provided so as not to contact the adjacent helical blades 74 with respect to the feeding direction. In the case where the stirring rib 77 does not contact the feeding back surface 76 of the adjacent helical blade 74 on the downstream side with respect to the feeding direction, compared with the case where the stirring rib 77 contacts the feeding back surface 76, the developer stirring property is improved. Further, the stirring rib 77 is provided with a gap (spacing) between itself and the feeding (front) surface 75 without contacting the feeding surface 75 of the adjacent helical blade 74 on the upstream side with respect to the feeding direction, so that compared with the case where the stirring rib 77 contacts the feeding surface 75, feeding of the developer on the feeding surface 75 is not readily obstructed by the stirring rib 77. That is, although the stirring rib 77 improving the developer feeding property is provided, a lowering in developer feeding property by the stirring rib 77 can be suppressed. Thus, according to this embodiment, it is possible to easily realize improvement in developer stirring property without lowering the developer feeding property to the extent possible.

Second Embodiment

Figure 6:
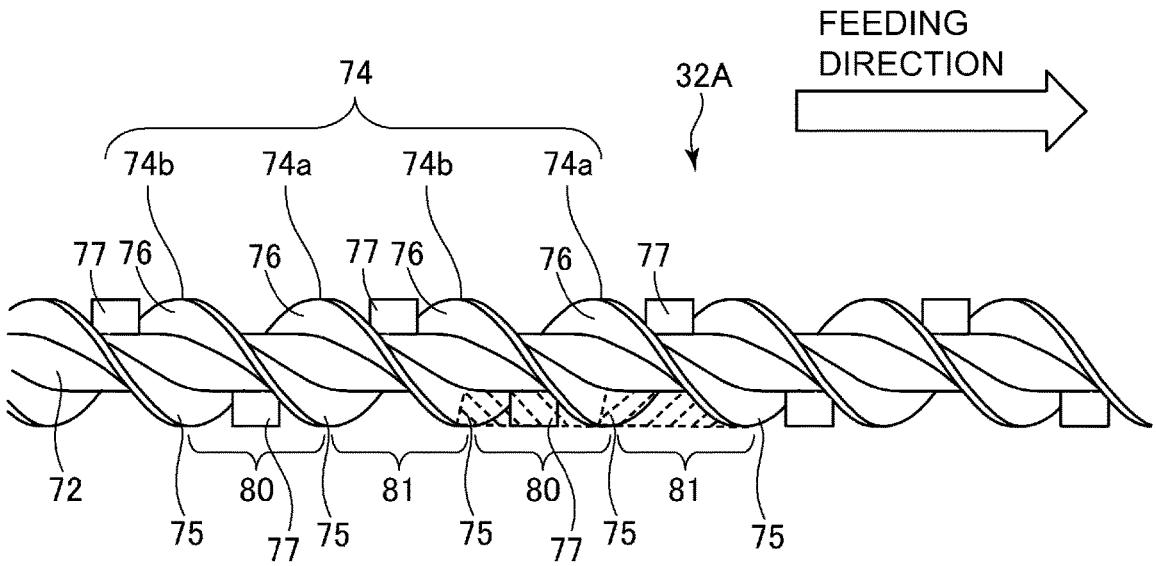
FIG. 6 is a schematic view showing a part of a stirring screw which is a two-thread screw in a Second Embodiment.

In the above-described First Embodiment, the stirring rib 77 of the stirring screw 32 does not contact the adjacent helical blades 74 with respect to the feeding direction, but the present invention is not limited thereto. The stirring rib 77 may also contact the adjacent helical blade on the upstream side with respect to the feeding direction in order to further enhance the developer stirring property. However, in such a case, compared with the case where the stirring rib 77 does not contact the adjacent helical blade, the developer feeding property on the feeding surface 75 is liable to lower. Therefore, in order to make up for the lowering in developer feeding property due to contact of the stirring rib 77 with the helical blade 74 on the upstream side with respect to the feeding direction, the stirring screw in this embodiment is provided with a region in which the stirring rib 77 is provided and a region in which the stirring rib 77 is not provided. Such a stirring screw in this embodiment will be described using FIGS. 6 and 7. FIG. 6 shows the case where the stirring screw is the two-thread screw, and FIG. 7 shows the case where the stirring screw is the three-thread screw.

A stirring screw 32A shown in FIG. 6 is provided with the stirring rib 77 in the first region 80 between adjacent helical blades with respect to the feeding direction but is not provided with the stirring rib 77 in a second region 81 which is different from the first region 80 and which is positioned between adjacent helical blades with respect to the feeding direction. In other words, the stirring screw 32A includes the first region 80 in which the stirring rib 77 is provided and the second region 81 in which the stirring rib 77 is not provided. The second region 81 indicated by a hatched line in the figure is a region under the rotation shaft 72 between the helical blades. Further, in the case of this embodiment, the first region 80 and the second region 81 are alternately disposed. In the first region 80, the stirring rib 77 is provided so as to contact the adjacent helical blade 74 on the upstream side with respect to the feeding direction. In the case of this embodiment, the stirring rib 77 contacts the feeding surface 75 of the first helical blade 74*a* but does not contact the feeding back surface 76 of the second helical blade 74*b*.

Figure 7:
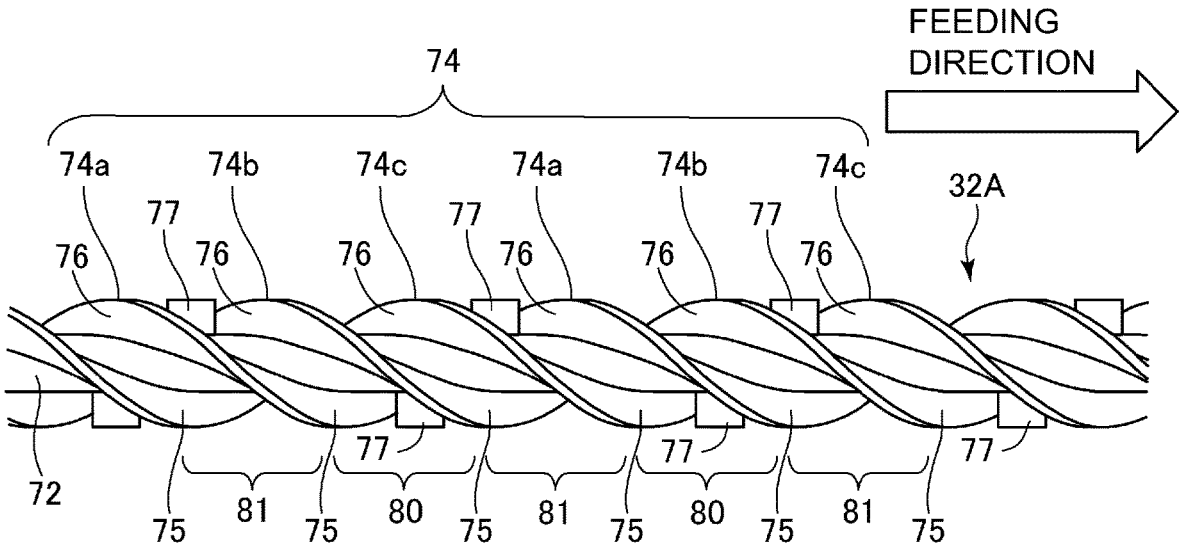
FIG. 7 is a schematic view showing a part of a stirring screw which is a three-thread screw in the Second Embodiment.

On the other hand, also as regards a stirring screw 32A shown in FIG. 7, a first region 80 in which the stirring rib 77 is provided and a second region 81 in which the stirring rib 77 is not provided are alternately provided. Also in this case, in the first region 80, the stirring rib 77 is provided so as to contact the adjacent helical blade 74 on the upstream side with respect to the feeding direction.

As described above, as regards the stirring screw 32A in the Second Embodiment, the first region 80 in which the stirring rib 77 is provided and the second region 81 in which the stirring rib 77 is not provided are alternately disposed. In this case, in the first region 80 in which the stirring rib 77 is provided, compared with the second region 81, the developer stirring property is improved, while the developer feeding property lowers. On the other hand, in the first region 80 in which the stirring rib 77 is not provided, the developer feeding property is improved, while the developer stirring property lowers. By alternately disposing the first region 80 and the second region 81, a region in which the developer stirring property is good and a region in which the developer feeding property is good can be alternately formed, so that the developer stirring property can be improved without largely lowering a total developer feeding property. Thus, also in this embodiment (Second Embodiment), an effect similar to the above-described effect of the First Embodiment such that the developer stirring property can be improved without lowering the developer feeding property to the extent possible can be obtained.

Incidentally, also in the case of this embodiment, the stirring rib 77 may also be disposed, for example, at an intermediary portion between the adjacent first helical blade 74*a* and the adjacent second helical blade 74*b* so as not to contact the feeding surface 75 of the first helical blade 74*a* and the feeding back surface 76 of the second helical blade 74*b*.

Third Embodiment

In the above-described First and Second Embodiments, the stirring screw formed so that the stirring rib 77 has the substantially same height (for example, 4 mm) with respect to the radial direction and has the same length (for example, 5 mm) with respect to the feeding direction was described as an example. However, in order to change the developer stirring property with respect to the feeding direction, the height of the stirring rib 77 with respect to the radial direction and the length of the stirring rib 77 with respect to the feeding direction may also be changed. Therefore, in this embodiment (Third Embodiment), the case where the height of the stirring rib 77 with respect to the radial direction is changed will be described. Then, in a Fourth Embodiment, the case where the length of the stirring rib 77 with respect to the feeding direction is changed will be described.

Figure 8:
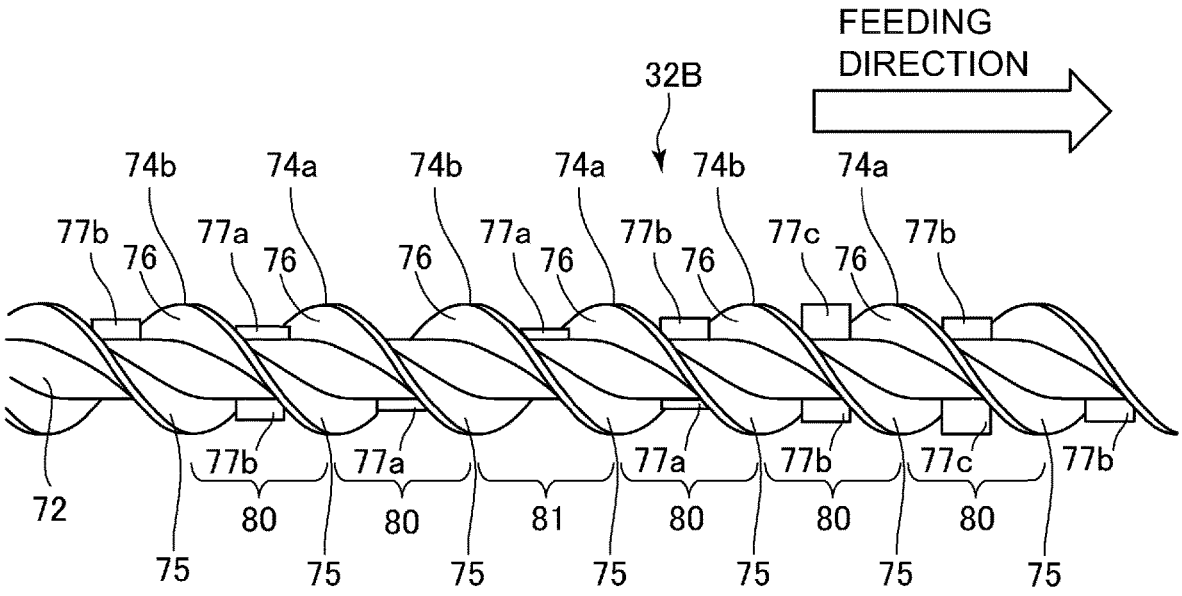
FIG. 8 is a schematic view showing a part of a stirring screw which is a two-thread screw in a Third Embodiment.

First, the feeding screw in the Third Embodiment in which the height of the stirring rib 77 with respect to the radial direction is changed will be described using FIGS. 8 and 9. FIG. 8 shows the case where the stirring screw is a two-thread screw, and FIG. 9 shows the case where the stirring screw is a three-thread screw.

A stirring screw 32B shown in FIG. 8 is provided with three kinds of stirring ribs 77*a*, 77*b* and 77*c* different from each other in height with respect to the radial direction in associated ones of the first regions 80. A radial direction height (first height) of the stirring rib 77*c* (first plate-like projection portion) having a maximum radial direction height may preferably be a height (for example, 4 mm) such that the outer peripheral end of the stirring rib 77*c* does not project in the radial direction more than the outer peripheral end of the helical blade 74. On the other hand, a radial direction height (second height) of the stirring rib 77*a* (second plate-like projection portion) having a minimum radial direction height may preferably be less than a half of the radial direction height of the stirring rib 77*c*. As an example, in the case where the radial direction height of the stirring rib 77*c* having the maximum radial direction height is 4 mm, the radial direction height of the stirring rib 77*a* having the minimum radial direction height is 2 mm, and the radial direction height of the stirring rib 77*b* having an intermediary radial direction height is 3 mm.

Further, in the case where the first regions 80 continuously exist, the stirring ribs 77*a* to 77*c* different in radial direction height may be disposed so that the radial direction height gradually becomes high or low with movement of the developer from the upstream side toward the downstream side with respect to the feeding direction. As a result, a change of a lowering in developer feeding property between adjacent first regions 80 of the continuous first regions 80 is small, and the developer feeding property does not readily lower extremely, thus being preferred. Further, in the case where the second regions 81 exist, the stirring rib 77*a* having the low radial direction height may preferably be disposed so that the developer feeding property in the first region 80 adjacent to the second region 81 does not largely diverge from the developer feeding property in the second region 81.

Figure 9:
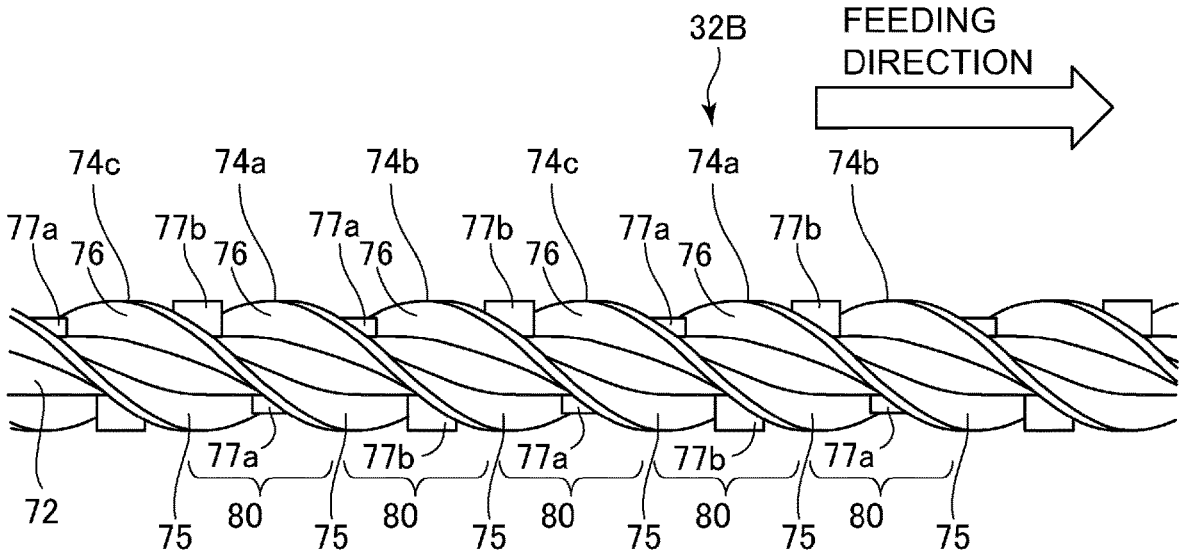
FIG. 9 is a schematic view showing a part of a stirring screw which is a three-thread screw in the Third Embodiment.

In a stirring screw 32B shown in FIG. 9, each of two kinds of stirring ribs 77*a* and 77*b* different from each other in radial direction height is provided in the first region 80. In this case, in order to suppress a change in lowering of the developer feeding property between consecutive first regions 80, the first region 80 in which the stirring rib 77*b* having a high radial direction height is provided and the first region 80 in which the stirring rib 77*a* having a low radial direction height is provided may preferably be alternately disposed. As an example, the radial direction height of the stirring rib 77*b* having the high radial direction height is 4 mm, and the radial direction height of the stirring rib 77*a* having the low radial direction height is 2 mm.

Fourth Embodiment

Figure 10:
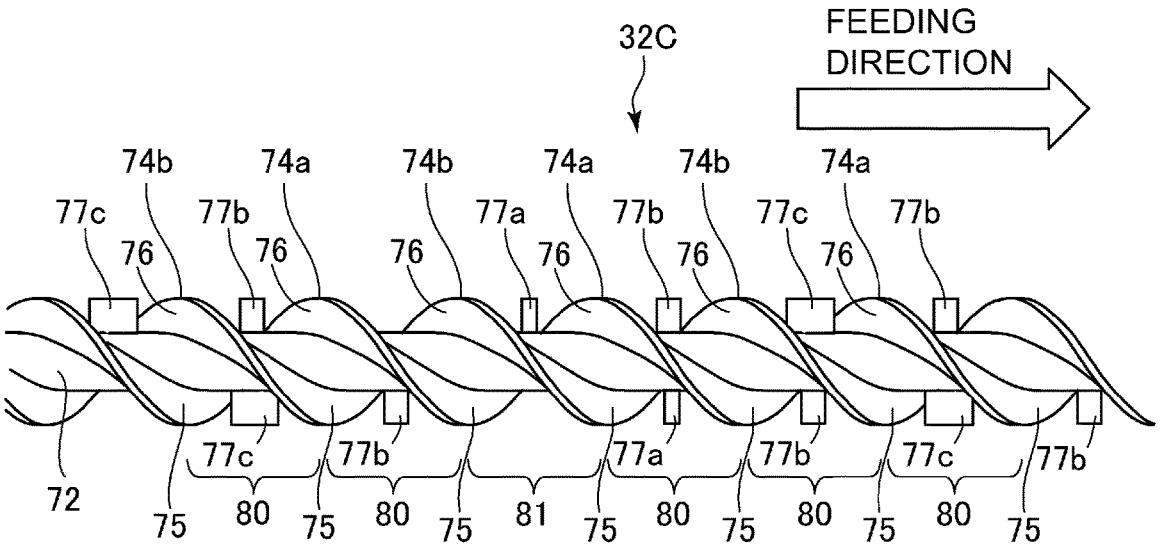
FIG. 10 is a schematic view showing a part of a stirring screw which is a two-thread screw in a Fourth Embodiment.

Next, the feeding screw in the Fourth Embodiment in which the length of the stirring rib 77 with respect to the feeding direction is changed will be described using FIGS. 10 and 11. FIG. 10 shows the case where the stirring screw is a two-thread screw, and FIG. 11 shows the case where the stirring screw is a three-thread screw.

Figure 12:
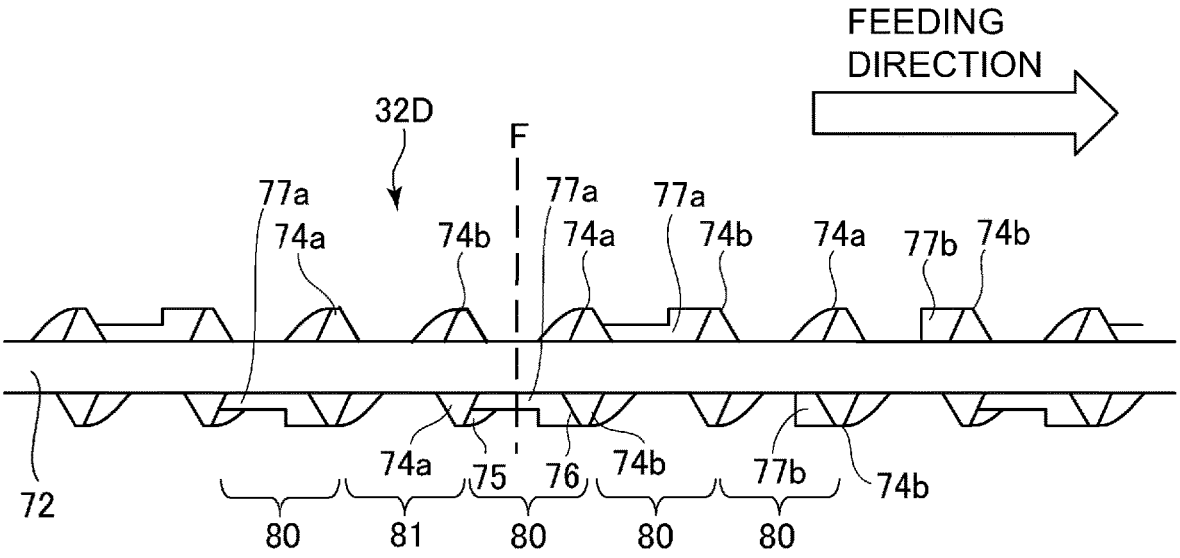
FIG. 12 is a schematic view showing a feeding screw in another embodiment.

A stirring screw 32C shown in FIG. 10 is provided with three kinds of stirring ribs 77*a*, 77*b* and 77*c* different from each other in length with respect to the feeding direction in associated ones of the first regions 80. A feeding direction length of the stirring rib 77*c* having a maximum feeding direction length may be a length (for example, 15 mm which is a half pitch) such that both ends of the stirring rib 77*c* with respect to the feeding property contact the adjacent helical blades as described later (FIG. 12). As an example, the feeding direction length (maximum length) of the stirring rib 77*c* (first plate-like projection portion) having the maximum feeding direction length (first length) is 5 mm, the feeding direction length of the stirring rib 77*a* (second plate-like projection portion) having the minimum feeding direction length (second length) is 2 mm, and the feeding direction length of the stirring rib 77*b* having an intermediary feeding direction length is 3 mm.

Further, in the case where the first regions 80 continuously exist, as shown in FIG. 10, the stirring ribs 77*a* to 77*c* different in feeding direction length may be disposed so that the feeding direction length gradually becomes long or short with movement of the developer from the upstream side toward the downstream side with respect to the feeding direction. As a result, a change of a lowering in developer feeding property between adjacent first regions 80 of the continuous first regions 80 is small, and the developer feeding property does not readily lower extremely, thus being preferred. Further, in the case where the second regions 81 exist, the stirring rib 77*a* having the short feeding direction length may preferably be disposed so that the developer feeding property in the first region 80 adjacent to the second region 81 does not largely diverge from the developer feeding property in the second region 81.

Figure 11:
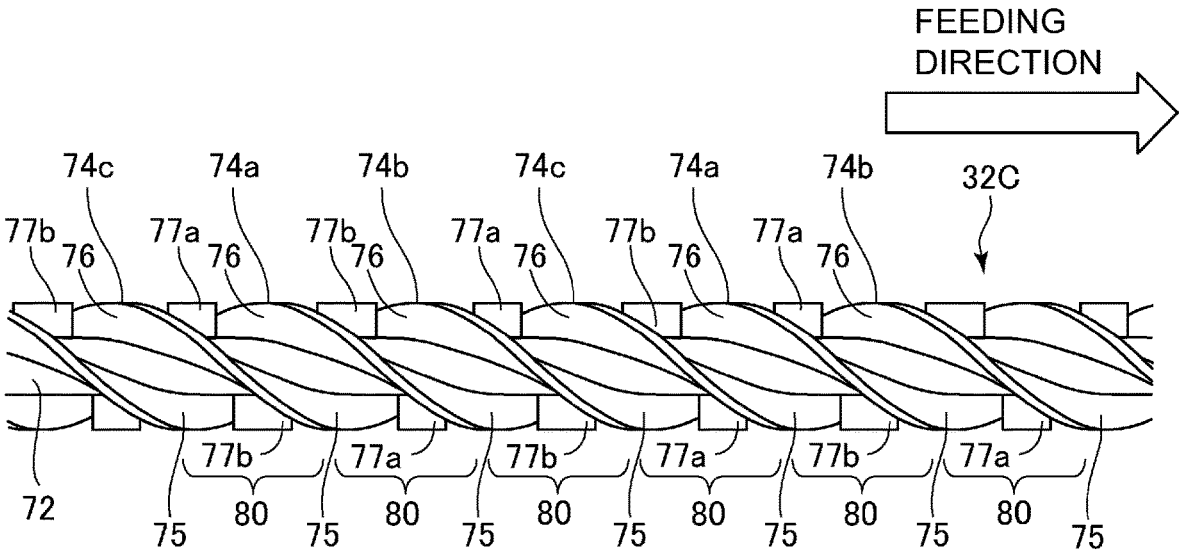
FIG. 11 is a schematic view showing a part of a stirring screw which is a three-thread screw in the Fourth Embodiment.

In a stirring screw 32C shown in FIG. 11, each of two kinds of stirring ribs 77*a* and 77*b* different from each other in feeding direction length is provided in the first region 80. In this case, the first region 80 in which the stirring rib 77*b* (first plate-like projection portion) having a long feeding direction length (first length) is provided and the first region 80 in which the stirring rib 77*a* (second plate-like projection portion) having a short feeding direction length (second length) is provided may preferably be alternately disposed. As an example, the feeding direction length of the stirring rib 77*b* having the long feeding direction length is 7 mm, and the feeding direction length of the stirring rib 77*a* having the short feeding direction length is 5 mm. As a result, in the continuous first regions 80, a change in developer feeding property can be suppressed between the adjacent first rollers 80.

Also in the cases of the above-described Third and Fourth Embodiments, an effect similar to the effect of the above-described First Embodiment such that the developer stirring property can be improved without lowering the developer feeding property to the extent possible can be obtained.

Incidentally, in the Third and Fourth Embodiments, shapes of the first plate-like projection portion and the second plate-like projection portion, particularly heights and lengths of the first plate-like projection portion and the second plate-like projection portion are made different from each other, but even in a constitution in which areas of the first plate-like projection portion and the second plate-like projection portion are made different from each other, a similar effect can be achieved.

Other Embodiments

In the above-described First to Fourth Embodiments, the case where the stirring rib 77 is provided so as not to contact the adjacent helical blades 74 with respect to the feeding direction or the case where the stirring rib 77 is provided so as to contact the helical blade 74 on the upstream side with respect to the feeding direction was described as an example, but the present invention is not limited thereto. For example, as in the case of a stirring screw 32D shown in FIG. 12, the stirring rib 77*a* may also be provided so as to contact both the helical blade 74 on the upstream side and the helical blade 74 on the downstream side with respect to the feeding direction. In this case, the respective stirring ribs 77*a* may preferably be formed in shapes such that the radial direction heights thereof are different from each other with respect to the feeding direction. As an example, each of the stirring ribs 77*a* is formed to have radial direction heights different from each other so that an area of the stirring rib 77*a* on the upstream side with respect to the feeding direction is smaller than an area of the stirring rib 77*a* on the downstream side with respect to the feeding direction on the basis of a center line F of the first region 80 with respect to the feeding direction. This is because the feeding of the developer on the feeding surface 75 is not readily obstructed by decreasing the area of the stirring rib 77*a* contacting the feeding surface 75 on the upstream side with respect to the feeding direction and because the developer stirring property is improved by increasing the area of the stirring rib 77*a* contacting the feeding back surface 76 on the downstream side with respect to the feeding direction. Thus, it is possible to easily realize improvement of the developer stirring property without lowering the developer feeding property to the extent possible.

Further, as shown in FIG. 12, the stirring rib 77*b* may also be provided so as not to contact the helical blade 74 (specifically the feeding surface 75) on the upstream side with respect to the feeding direction, while it may also be provided so as to contact the helical blade 74 (specifically, the feeding back surface 76) on the downstream side with respect to the feeding direction.

Incidentally, the above-described embodiments are not limited to application to the stirring screw 32 or the developing screw 31 but may also be applied to, for example, a supplying screw for supplying the developer from the supplying device to the developing device 4, or the like screw.

The above-described embodiments are not limited to application to the developing device of a horizontally stirring type in which the developer container 41 is partitioned into the developing chamber 21 and the stirring chamber 22 in the horizontal direction but may also be, for example, applicable to a developing device of a vertically stirring type in which the developer container 41 is partitioned into the developing chamber 21 and the stirring chamber 22 in a vertical direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-009112 filed on Jan. 23, 2018, which is hereby incorporated by reference herein in its entirety.

What is claimed is:

1. A developing device comprising:

a developer bearing member configured to bear a developer containing toner and a carrier;

a first chamber configured to supply the developer to said developer bearing member;

a second chamber partitioned from said first chamber by a partition wall;

a first communication portion configured to permit the developer to communicate from said second chamber to said first chamber;

a second communication portion configured to permit the developer to communicate from said first chamber to said second chamber;

a first feeding screw provided in said first chamber and configured to feed the developer in a first direction from said first communication portion to said second communication portion; and a second feeding screw provided in said second chamber and configured to feed the developer in a second direction from said second communication portion to said first communication portion;

wherein said second feeding screw includes a rotation shaft, and a first helical blade and a second helical blade which are formed around said rotation shaft and which form a multi-thread helical blade, wherein said second feeding screw includes a first region in which a first plate-like projection portion is provided on said rotation shaft between said first helical blade and said second helical blade, and includes a second region, adjacent to said first region with respect to the second direction, in which a second plate-like projection portion is provided on said rotation shaft between said first helical blade and said second helical blade, and wherein a maximum length of said second plate-like projection portion with respect to the second direction is shorter than a maximum length of said first plate-like projection portion with respect to the second direction.

2. A developing device according to claim 1, wherein said second feeding screw further includes a third region, adjacent to said second region with respect to the second direction, in which a plate-like projection portion is not provided between said first helical blade and said second helical blade.

3. A developing device according to claim 1, wherein an area of said second plate-like projection portion is smaller than an area of said first plate-like projection portion.

4. A developing device according to claim 1, wherein a plurality of sets of said first region and said second region are provided continuously.

5. A developing device according to claim 1, wherein in said first region, said first plate-like projection portion contacts each of said first helical blade and said second helical blade.

6. A developing device according to claim 2, wherein a plurality of sets of said first region, said second region, and said third region are provided.

7. A developing device according to claim 1, wherein in said first region, a gap is provided between said first plate-like projection portion and each of said first helical blade and said second helical blade with respect to the second direction, and in said second region, a gap is provided between said second plate-like projection portion and each of said first helical blade and said second helical blade with respect to the second direction.

8. A developing device comprising:

a developer bearing member configured to bear a developer containing toner and a carrier;

a first chamber configured to supply the developer to said developer bearing member;

a second chamber partitioned from said first chamber by a partition wall;

a first communication portion configured to permit the developer to communicate from said second chamber to said first chamber;

a second communication portion configured to permit the developer to communicate from said first chamber to said second chamber;

a first feeding screw provided in said first chamber and configured to feed the developer in a first direction from said first communication portion to said second communication portion; and a second feeding screw provided in said second chamber and configured to feed the developer in a second direction from said second communication portion to said first communication portion, wherein said second feeding screw includes a rotation shaft, and a first helical blade and a second helical blade which are formed around said rotation shaft and which form a two-thread helical blade, wherein when viewed from a direction perpendicular to said rotation shaft of said second feeding screw, said second feeding screw includes, downstream of said second communication portion and upstream of said first communication portion with respect to the second direction, a first region in which a plate-like projection portion is provided on said rotation shaft between said first helical blade and said second helical blade in a position at an angle of 360° in a rotational direction of said second feeding screw, a second region, adjacent to said first region with respect to the second direction, in which a plate-like projection portion is not provided on said rotation shaft between said first helical blade and said second helical blade in a position at an angle of 360° in a rotational direction of said second feeding screw, and a third region, adjacent to said second region with respect to the second direction, in which a plate-like projection portion is provided on said rotation shaft between said first helical blade and said second helical blade in a position at an angle of 360° in a rotational direction of said second feeding screw.

9. A developing device according to claim 8, wherein a plurality of sets of said first region, said second region, and said third region are provided downstream of said second communication portion and upstream of said first communication portion with respect to the second direction.

10. A developing device comprising:

a developer bearing member configured to bear a developer containing toner and a carrier;

a first chamber configured to supply the developer to said developer bearing member;

a second chamber partitioned from said first chamber by a partition wall;

a first communication portion configured to permit the developer to communicate from said second chamber to said first chamber;

a second communication portion configured to permit the developer to communicate from said first chamber to said second chamber;

a first feeding screw provided in said first chamber and configured to feed the developer in a first direction from said first communication portion to said second communication portion; and a second feeding screw provided in said second chamber and configured to feed the developer in a second direction from said second communication portion to said first communication portion, wherein said second feeding screw includes a rotation shaft, and a first helical blade, a second helical blade, and a third helical blade which are formed around said rotation shaft and which form a three-thread helical blade, wherein when viewed from a direction perpendicular to said rotation shaft of said second feeding screw, said second feeding screw includes, downstream of said second communication portion and upstream of said first communication portion with respect to the second direction, a first region in which a plate-like projection portion is provided on said rotation shaft between said first helical blade and said second helical blade in a position at an angle of 360° in a rotational direction of said second feeding screw, a second region, adjacent to said first region with respect to the second direction, in which a plate-like projection portion is not provided on said rotation shaft between said second helical blade and said third helical blade in a position at an angle of 360° in a rotational direction of said second feeding screw, and a third region, adjacent to said second region with respect to the second direction, in which a plate-like projection portion is provided on said rotation shaft between said first helical blade and said third helical blade in a position at an angle of 360° in a rotational direction of said second feeding screw.

11. A developing device according to claim 10, wherein a plurality of sets of said first region, said second region, and said third region are provided downstream of said second communication portion and upstream of said first communication portion with respect to the second direction.

12. A developing device comprising:

a developer bearing member configured to bear a developer containing toner and a carrier;

a first chamber configured to supply the developer to said developer bearing member;

a second chamber partitioned from said first chamber by a partition wall;

a first communication portion configured to permit the developer to communicate from said second chamber to said first chamber;

a second communication portion configured to permit the developer to communicate from said first chamber to said second chamber;

a first feeding screw provided in said first chamber and configured to feed the developer in a first direction from said first communication portion to said second communication portion; and a second feeding screw provided in said second chamber and configured to feed the developer in a second direction from said second communication portion to said first communication portion, wherein said second feeding screw includes a rotation shaft, and a first helical blade, a second helical blade, and a third helical blade which are formed around said rotation shaft and which form a three-thread helical blade, wherein said second feeding screw includes, downstream of said second communication portion and upstream of said first communication portion with respect to the second direction, a first region in which a first plate-like projection portion is provided on said rotation shaft between said first helical blade and said second helical blade in a position at an angle of 360° in a rotational direction of said second feeding screw, a second region, adjacent to said first region with respect to the second direction, in which a second plate-like projection portion is provided on said rotation shaft between said second helical blade and said third helical blade in a position at an angle of 360° in a rotational direction of said second feeding screw, a third region, adjacent to said second region with respect to the second direction, in which a third plate-like projection portion is provided on said rotation shaft between said first helical blade and said third helical blade in a position at an angle of 360° in a rotational direction of said second feeding screw, wherein a maximum length of said second plate-like projection portion projected from said rotational shaft is shorter than a maximum length of said first plate-like projection portion projected from said rotational shaft, and wherein a maximum length of said second plate-like projection portion projected from said rotational shaft is shorter than a maximum length of said third plate-like projection portion projected from said rotational shaft.

13. A developing device according to claim 12, wherein a plurality of sets of said first region, said second region, and said third region are provided downstream of said second communication portion and upstream of said first communication portion with respect to the second direction.

* * * * *